US005894897A

United States Patent [19]

Vail, III

[11] Patent Number: 5,894,897

[45] **Date of Patent: *Apr. 20, 1999**

[54] METHOD AND APPARATUS FOR CEMENTING DRILL STRINGS IN PLACE FOR ONE PASS DRILLING AND COMPLETION OF OIL AND GAS WELLS

[76] Inventor: William Banning Vail, III, 3123-198th PL. SE., Bothell, Wash. 98012

[ * ] Notice: This patent is subject to a terminal disclaimer.

[21] Appl. No.: 08/708,396

[22] Filed: Sep. 3, 1996

Related U.S. Application Data

[63] Continuation-in-part of application No. 08/323,152, Oct. 14, 1994, Pat. No. 5,551,521.

[51] Int. Cl.[6] ..... F21B 7/20; F21B 27/00

[52] U.S. Cl. ..... 175/318; 166/285

[58] Field of Search ..... 175/317, 318, 175/402, 107; 166/295, 290, 285

[56] References Cited

U.S. PATENT DOCUMENTS

| | | | |
|---|---|---|---|
| 2,621,742 | 12/1952 | Brown | 166/290 X |
| 2,738,011 | 3/1956 | Mabry | 166/290 X |
| 5,551,521 | 9/1996 | Vail, III | 175/65 |

FOREIGN PATENT DOCUMENTS

| | | | |
|---|---|---|---|
| 1618870 | 1/1991 | U.S.S.R. | 166/285 |

*Primary Examiner*—David J Bagnell

[57] ABSTRACT

The steel drill string attached to a drilling bit during typical rotary drilling operations used to drill oil and gas wells is used for a second purpose as the casing that is cemented in place during typical oil and gas well completions. Methods of operation are described that provide for the efficient installation a cemented steel cased well wherein the drill string and the drill bit are cemented into place during one single drilling pass down into the earth. The normal mud passages or watercourses present in the rotary drill bit are used for the second independent purpose of passing cement into the annulus between the casing and the well while cementing the drill string into place during one single pass into the earth. A one-way cement valve is installed near the drill bit of the drill string that allows the cement to set up efficiently under ambient hydrostatic conditions while the drill string and drill bit are cemented into place during one single drilling pass into the earth. That one-way cement valve can be pumped down from the surface or can be permanently installed above the rotary drill bit. Procedures are described to drill a borehole with a tubing conveyed mud motor drilling apparatus that is cemented in place to make a tubing encased well.

4 Claims, 3 Drawing Sheets

METHOD AND APPARATUS FOR CEMENTING DRILL STRINGS IN PLACE FOR ONE PASS DRILLING AND COMPLETION OF OIL AND GAS WELLS

This application is a continuation-in-part of application Ser. No. 08/323,152, filed Oct. 14, 1994, having the title of "Method and Apparatus for Cementing Drill Stings in Place for One Pass Drilling and Completion of Oil and Gas Wells", that issued on Sep. 3, 1996 as U.S. Pat. No. 5,551,521 that is included herein in its entirety by reference. Portions of this application were disclosed in U.S. Disclosure Document No. 362582 filed on Sep. 30, 1994 that is incorporated herein by reference.

BACKGROUND OF THE INVENTION

1. Field of Invention

The field of invention relates to apparatus that uses the steel drill string attached to a drilling bit during drilling operations used to drill oil and gas wells for a second purpose as the casing that is cemented in place during typical oil and gas well completions. The field of invention further relates to methods of operation of said apparatus that provides for the efficient installation a cemented steel cased well during one single pass down into the earth of the steel drill string. The field of invention further relates to methods of operation of the apparatus that uses the typical mud passages already present in a typical drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single drilling pass into the earth. The field of invention further relates to apparatus and methods of operation that provides the pumping of cement down the drill string, through the mud passages in the drill bit, and into the annulus between the formation and the drill string for the purpose of cementing the drill string and the drill bit into place during one single drilling pass into the formation. The field of invention further relates to a one-way cement valve and related devices installed near the drill bit of the drill string that allows the cement to set up efficiently while the drill string and drill bit are cemented into place during one single drilling pass into the formation.

2. Description of the Prior Art

At the time of the filing of the application herein, the applicant is unaware of any prior art that is particularly relevant to the invention other than that cited by the USPTO during the prosecution of the parent application (Ser. No. 08/323,152).

SUMMARY OF THE INVENTION

Apparatus and methods of operation of that apparatus are disclosed that allow for cementation of a drill string with attached drill bit into place during one single drilling pass into a geological formation. The process of drilling the well and installing the casing becomes one single process that saves installation time and reduces costs during oil and gas well completion procedures. Apparatus and methods of Sep. 2, 1996 operation of the apparatus are disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process" that involves only 7 separate steps as described in the Description of the Preferred Embodiments below. The New Drilling Process is now possible because of "Several Recent Changes in the Industry" also described in the Description of the Preferred Embodiments below. In addition, the New Drilling Process also requires new apparatus to properly allow the cement to cure under ambient hydrostatic conditions. That new apparatus includes a Latching Subassembly, a Latching Float Collar Valve Assembly, the Bottom Wiper Plug, and the Top Wiper Plug. Suitable methods of operation are disclosed for the use of the new apparatus.

DESCRIPTION OF THE PREFERRED EMBODIMENTS

Apparatus and methods of operation of that apparatus are disclosed herein in the preferred embodiments of the invention that allow for cementation of a drill string with attached drill bit into place during one single drilling pass into a geological formation. The method of drilling the well and installing the casing becomes one single process that saves installation time and reduces costs during oil and gas well completion procedures as documented in the following description of the preferred embodiments of the invention. Apparatus and methods of operation of the apparatus are disclosed herein that use the typical mud passages already present in a typical rotary drill bit, including any watercourses in a "regular bit", or mud jets in a "jet bit", for the second independent purpose of passing cement into the annulus between the casing and the well while cementing the drill string in place.

Figure 1:
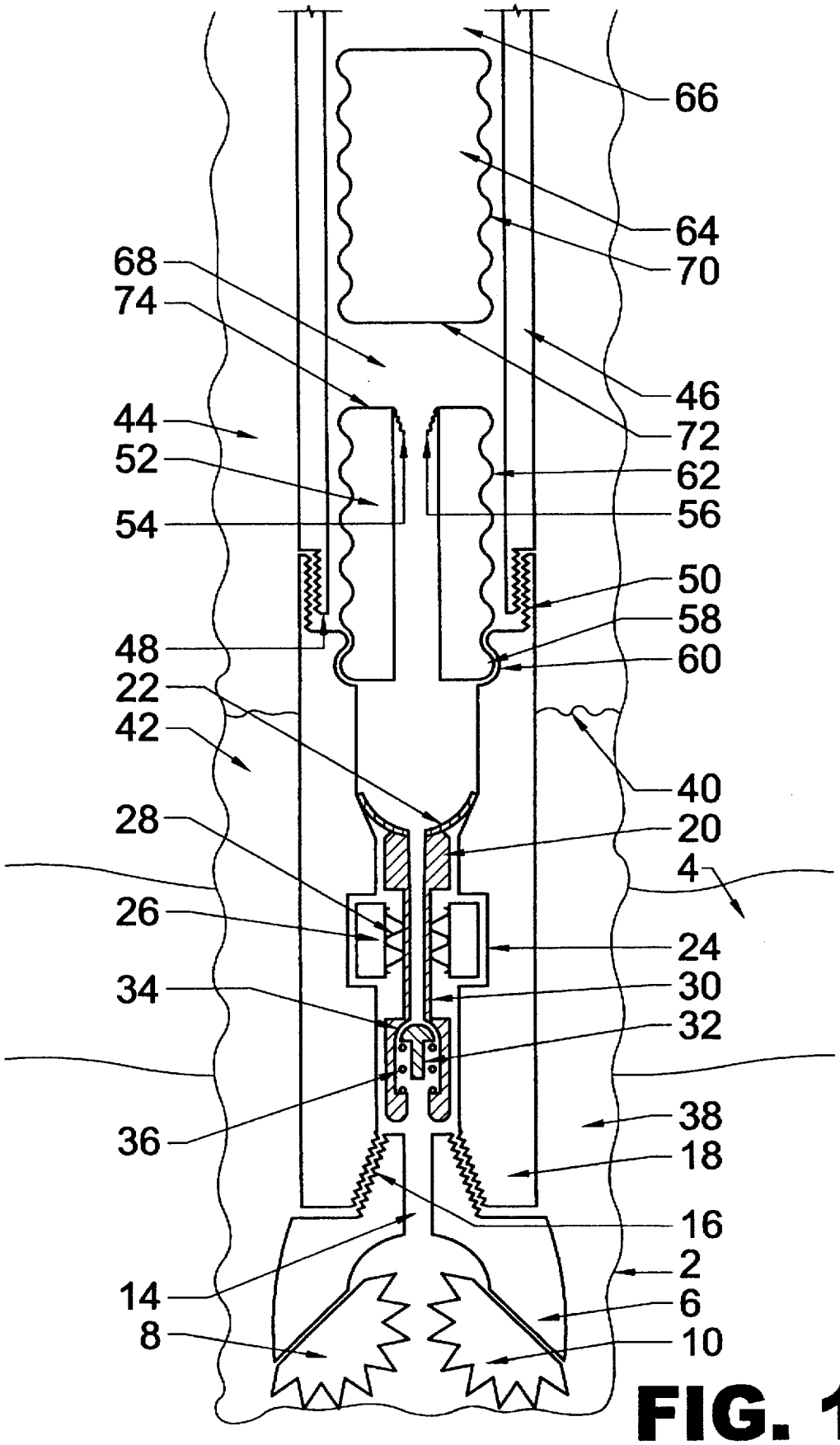
FIG. 1 shows a section view of a rotary drill string having a rotary drill bit in the process of being cemented in place during one drilling pass into formation by using a Latching Float Collar Valve Assembly that has been pumped into place above the rotary drill bit that is a preferred embodiment of the invention.

FIG. 1 shows a section view of a drill string in the process of being cemented in place during one drilling pass into formation. A borehole 2 is drilled though the earth including geological formation 4. The borehole is drilled with a milled tooth rotary drill bit 6 having milled steel roller cones 8, 10, and 12 (not shown for simplicity). A standard water passage 14 is shown through the rotary cone drill bit. This rotary bit could equally be a tungsten carbide insert roller cone bit having jets for waterpassages, the principle of operation and the related apparatus being the same for either case for the preferred embodiment herein.

The threads 16 on rotary drill bit 6 are screwed into the Latching Subassembly 18. The Latching Subassembly is also called the Latching Sub for simplicity herein. The Latching Sub is a relatively thick-walled steel pipe having some functions similar to a standard drill collar.

The Latching Float Collar Valve Assembly 20 is pumped downhole with drilling mud after the depth of the well is reached. The Latching Float Collar Valve Assembly is pumped downhole with mud pressure pushing against the Upper Seal 22 of the Latching Float Collar Valve Assembly. The Latching Float Collar Valve Assembly latches into place into Latch Recession 24. The Latch 26 of the Latching Float Collar Valve Assembly is shown latched into place with Latching Spring 28 pushing against Latching Mandrel 30, when the Latch 26 is properly seated into place within the Latch Recession 24, the clearances and materials of the Latch and mating Latch Recession are to be chosen such that very little cement will leak through the region of the Latch Recession 24 of the Latching Subassembly 18 under any back-pressure (upward pressure) in the well. Many means can be utilized to accomplish this task, including fabricating the Latch 26 from suitable rubber compounds suitabley designing the upper portion of the latching Float Collar Value Assembly 20 immediately below the Upper Seal 22, the use of various 0-rings within or near Latch Recession 24, etc.

The Float 32 of the Latching Float Collar Valve Assembly seats against the Float Seating Surface 34 under the force from Float Collar Spring 36 that makes a one-way cement valve. However, the pressure applied to the mud or cement from the surface may force open the Float to allow mud or cement to be forced into the annulus generally designated as 38 in FIG. 1. This one-way cement value is a particular example of "a one-way cement valve means installed near the drill bit" which is a term defined herein. The one-way cement valve means may be installed at any distance from the drill bit but is preferentially installed "near" the drill bit.

FIG. 1 corresponds to the situation where cement is in the process of being forced from the surface through the Latching Float Collar Valve Assembly. In fact, the top level of cement in the well is designated as element 40. Below 40, cement fills the annulus of the borehole. Above 40, mud fills the annulus of the borehole. For example, cement is present at position 42 and drilling mud is present at position 44 in FIG. 1.

Relatively thin-wall casing, or drill pipe, designated as element 46 in FIG. 1, is attached to the Latching Sub. The bottom male threads of the drill pipe 48 are screwed into the female threads 50 of the Latching Sub.

The drilling mud was wiped off the walls of the drill pipe in the well with Bottom Wiper Plug 52. The Bottom Wiper Plug is fabricated from rubber in the shape shown. Portions 54 and 56 of the Upper Seal of the Bottom Wiper Plug are shown in a ruptured condition in FIG. 1. Initially, they sealed the upper portion of the Bottom Wiper Plug. Under pressure from cement, the Bottom Wiper Plug is pumped down into the well until the Lower Lobe of the Bottom Wiper Plug 58 latches into place into Latching Sub Recession 60 in the Latching Sub. After the Bottom Wiper Plug latches into place, the pressure of the cement ruptures The Upper Seal of the Bottom Wiper Plug. A Bottom Wiper Plug Lobe 62 is shown in FIG. 1. Such lobes provide an efficient means to wipe the mud off the walls of the drill pipe while the Bottom Wiper Plug is pumped downhole with cement.

Top Wiper Plug 64 is being pumped downhole by water 66 under pressure in the drill pipe. As the Top Wiper Plug 64 is pumped down under water pressure, the cement remaining in region 68 is forced downward through the Bottom Wiper Plug, through the Latching Float Collar Valve Assembly, through the waterpassages of the drill bit and into the annulus in the well. A Top Wiper Plug Lobe 70 is shown in FIG. 1. Such lobes provide an efficient means to wipe the cement off the walls of the drill pipe while the Top Wiper Plug is pumped downhole with water.

After the Bottom Surface 72 of the Top Wiper Plug is forced into the Top Surface 74 of the Bottom Wiper Plug, almost the entire "cement charge" has been forced into the annulus between the drill pipe and the hole. As pressure is reduced on the water, the Float of the Latching Float Latching Float Collar Valve Assembly seals against the Float Seating Surface 34. As the water pressure is reduced on the inside of the drill pipe, then the cement in the annulus between the drill pipe and the hole can cure under ambient hydrostatic conditions. This procedure herein provides an example of the proper operation of a "one-way cement valve means".

Therefore, the preferred embodiment in FIG. 1 provides apparatus that uses the steel drill string attached to a drilling bit during drilling operations used to drill oil and gas wells for a second purpose as the casing that is cemented in place during typical oil and gas well completions.

The preferred embodiment in FIG. 1 provides apparatus and methods of operation of said apparatus that results in the efficient installation of a cemented steel cased well during one single pass down into the earth of the steel drill string thereby making a steel cased borehole or cased well.

The steps described herein in relation to the preferred embodiment in FIG. 1 provides a method of operation that uses the typical mud passages already present in a typical rotary drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single pass into the earth.

The preferred embodiment of the invention further provides apparatus and methods of operation that results in the pumping of cement down the drill string, through the mud passages in the drill bit, and into the annulus between the formation and the drill string for the purpose of cementing the drill string and the drill bit into place during one single drilling pass into the formation.

The apparatus described in the preferred embodiment in FIG. 1 also provide a one-way cement valve and related devices installed near the drill bit of the drill string that allows the cement to set up efficiently while the drill string and drill bit are cemented into place during one single drilling pass into the formation.

Methods of operation of apparatus disclosed in FIG. 1 have been disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process" that involves only 7 separate steps as described in detail below. The New Drilling Process is now possible because of "Several Recent Changes in the Industry" also described in detail below.

Typical procedures used in the oil and gas industries to drill and complete wells are well documented. For example, such procedures are documented in the entire "Rotary Drilling Series" published by the Petroleum Extension Service of The University of Texas at Austin, Austin, Tex. that is included herein by reference in its entirety comprised of the following: Unit I—"The Rig and Its Maintenance" (12 Lessons); Unit II—"Normal Drilling Operations" (5 Lessons); Unit III—Nonroutine Rig Operations (4 Lessons); Unit IV—Man Management and Rig Management (1 Lesson); and Unit V—Offshore Technology (9 Lessons). All of the individual Glossaries of all of the above Lessons are explicitly included in the specification herein and any and all definitions in those Glossaries shall be considered to be explicitly referenced and/or defined herein.

Additional procedures used in the oil and gas industries to drill and complete wells are well documented in the series entitled "Lessons in Well Servicing and Workover" published by the Petroleum Extension Service of The University of Texas at Austin, Austin, Tex. that is included herein by reference in its entirety comprised of all 12 Lessons. All of the individual Glossaries of all of the above Lessons are explicitly included in the specification herein and any and all definitions in those Glossaries shall be considered to be explicitly referenced and/or defined herein.

With reference to typical practices in the oil and gas industries, a typical drilling process may therefore be described in the following.

Typical Drilling Process

From an historical perspective, completing oil and gas wells using rotary drilling techniques have in recent times comprised the following typical steps:

Step 1. With a pile driver or rotary rig, install any necessary conductor pipe on the surface for attachment of the blowout preventer and for mechanical support at the wellhead.

Step 2. Install and cement into place any surface casing necessary to prevent washouts and cave-ins near the surface, and to prevent the contamination of freshwater sands as directed by state and federal regulations.

Step 3. Choose the dimensions of the drill bit to result in the desired sized production well. Begin rotary drilling of the production well with a first drill bit. Simultaneously circulate drilling mud into the well while drilling. Drilling mud is circulated downhole to carry rock chips to the surface, to prevent blowouts, to prevent excessive mud loss into formation, to cool the bit, and to clean the bit. After the first bit wears out, pull the drill string out, change bits, lower the drill string into the well and continue drilling. It should be noted here that each "trip" of the drill bit typically requires many hours of rig time to accomplish the disassembly and reassembly of the drill string, pipe segment by pipe segment.

Step 4. Drill the production well using a succession of rotary drill bits attached to the drill string until the hole is drilled to its final depth.

Step 5. After the final depth is reached, pull out the drill string and its attached drill bit.

Step 6. Perform open-hole logging of the geological formations to determine the amount of oil and gas present. This typically involves measurements of the porosity of the rock, the electrical resistivity of the water present, the electrical resistivity of the rock, certain neutron measurements from within the open-hole, and the use of Archie's Equations. If no oil and gas is present from the analysis of such open-hole logs, an option can be chosen to cement the well shut. If commercial amounts of oil and gas are present, continue the following steps.

Step 7. Typically reassemble drill bit and drill string into the well to clean the well after open-hole logging.

Step 8. Pull out the drill string and its attached drill bit.

Step 9. Attach the casing shoe into the bottom male pipe threads of the first length of casing to be installed into the well. This casing shoe may or may not have a one-way valve ("casing shoe valve") installed in its interior to prevent fluids from back-flowing from the well into the casing string.

Step 10. Typically install the float collar onto the top female threads of the first length of casing to be installed into the well which has a one-way valve ("float collar valve") that allows the mud and cement to pass only one way down into the hole thereby preventing any fluids from back-flowing from the well into the casing string. Therefore, a typical installation has a casing shoe attached to the bottom and the float collar valve attached to the top portion of the first length of casing to be lowered into the well. Please refer to pages 28–31 of the book entitled "Casing and Cementing", Unit II, Lesson 4, Second Edition, of the Rotary Drilling Series, Petroleum Extension Service, The University of Texas at Austin, Tex., 1982 (hereinafter defined as "Ref.1"). All of the individual definitions of words and phrases in the Glossary of Ref. 1 are explicitly included herein in their entirety.

Step 11. Assemble and lower the production casing into the well while back filling each section of casing with mud as it enters the well to overcome the buoyancy effects of the air filled casing (caused by the presence of the float collar valve), to help avoid sticking problems with the casing, and to prevent the possible collapse of the casing due to accumulated build-up of hydrostatic pressure.

Step 12. To "cure the cement under ambient hydrostatic conditions", typically execute a two-plug cementing procedure involving a first Bottom Wiper Plug before and a second Top Wiper Plug behind the cement that also minimizes cement contamination problems comprised of the following individual steps:

A. Introduce the Bottom Wiper Plug into the interior of the steel casing assembled in the well and pump down with cement that cleans the mud off the walls and separates the mud and cement (Ref. 1, pages 28–31).

B. Introduce the Top Wiper Plug into the interior of the steel casing assembled into the well and pump down with water under pump pressure thereby forcing the cement through the float collar valve and any other one-way valves present (Ref. 1, pages 28–31).

C. After the Bottom Wiper Plug and the Top Wiper Plug have seated in the float collar, release the pump pressure on the water column in the casing that results in the closing of the float collar valve which in turn prevents cement from backing up into the interior of the casing. The resulting interior pressure release on the inside of the casing upon closure of the float collar valve prevents distortions of the casing that might prevent a good cement seal (Ref. 1, page 30). In such circumstances, "the cement is cured under ambient hydrostatic conditions".

Step 13. Allow the cement to cure.

Step 14. Follow normal "final completion operations" that include installing the tubing with packers and perforating the casing near the producing zones. For a description of such normal final completion operations, please refer to the book entitled "Well Completion Methods", Well Servicing and Workover, Lesson 4, from the series entitled "Lessons in Well Servicing and Workover", Petroleum Extension Service, The University of Texas at Austin, Tex., 1971

(hereinafter defined as "Ref. 2"). All of the individual definitions of words and phrases in the Glossary of Ref. 2 are explicitly included herein in their entirety. Other methods of completing the well are described therein that shall, for the purposes of this application herein, also be called "final completion operations".

Several Recent Changes in the Industry

Several recent concurrent changes in the industry have made it possible to reduce the number of steps defined above. These changes include the following:

a. Until recently, drill bits typically wore out during drilling operations before the desired depth was reached by the production well. However, certain drill bits have recently been able to drill a hole without having to be changed. For example, please refer to the book entitled "The Bit", Unit I, Lesson 2, Third Edition, of the Rotary Drilling Series, The University of Texas at Austin, Tex., 1981 (hereinafter defined as "Ref. 3"). All of the individual definitions of words and phrases in the Glossary of Ref. 3 are explicitly included herein in their entirety. On page 1 of Ref. 3 it states: "For example, often only one bit is needed to make a hole in which the casing will be set." On page 12 of Ref. 3 it states in relation to tungsten carbide insert roller cone bits: "Bit runs as long as 300 hours have been achieved; in some instances, only one or two bits have been needed to drill a well to total depth." This is particularly so since the advent of the sealed bearing tri-cone bit designs appeared in 1959 (Ref. 3, page 7 ) having tungsten carbide inserts (Ref. 3, page 12). Therefore, it is now practical to talk about drill bits lasting long enough for drilling a well during one pass into the formation, or "one pass drilling".

b. Until recently, it has been impossible or impractical to obtain sufficient geophysical information to determine the presence or absence of oil and gas from inside steel pipes in wells. Heretofore, either standard open-hole logging tools or Measurement-While-Drilling ("MWD") tools were used in the open-hole to obtain such information. Therefore, the industry has historically used various openhole tools to measure formation characteristics. However, it has recently become possible to measure the various geophysical quantities listed in Step 6 above from inside steel pipes such as drill strings and casing strings. For example, please refer to the book entitled "Cased Hole Log Interpretation Principles/Applications", Schlumberger Educational Services, Houston, Tex., 1989. Please also refer to the article entitled "Electrical Logging: State-of-the-Art", by Robert E. Maute, The Log Analyst, May-June. 1992, pages 206–227.

Because drill bits typically wore out during drilling operations until recently, different types of metal pipes have historically evolved which are attached to drilling bits, which, when assembled, are called "drill strings". Those drill strings are different than typical "casing strings" run into the well. Because it was historically absolutely necessary to do open-hole logging to determine the presence or absence of oil and gas, the fact that different types of pipes were used in "drill strings" and "casing strings" was of little consequence to the economics of completing wells. However, it is possible to choose the "drill string" to be acceptable for a second use, namely as the "casing string" that is to be installed after drilling has been completed.

New Drilling Process

Therefore, the preferred embodiments of the invention herein reduces and simplifies the above 14 steps as follows:

Repeat Steps 1–2 above.

Steps 3–5 (Revised). Choose the drill bit so that the entire production well can be drilled to its final depth using only one single drill bit. Choose the dimensions of the drill bit for desired size of the production well. If the cement is to be cured under ambient hydrostatic conditions, attach the drill bit to the bottom female threads of the Latching Subassembly ("Latching Sub"). Choose the material of the drill string from pipe material that can also be used as the casing string. Attach the first section of drill pipe to the top female threads of the Latching Sub. Rotary drill the production well to its final depth during "one pass drilling" into the well. While drilling, simultaneously circulate drilling mud to carry the rock chips to the surface, to prevent blowouts, to prevent excessive mud loss into formation, to cool the bit, and to clean the bit.

Step 6 (Revised). After the final depth of the production well is reached, perform logging of the geological formations to determine the amount of oil and gas present from inside the drill pipe of the drill string. This typically involves measurements from inside the drill string of the necessary geophysical quantities as summarized in Item "b." of "Several Recent Changes in the Industry". If such logs obtained from inside the drill string show that no oil or gas is present, then the drill string can be pulled out of the well and the well filled in with cement. If commercial amounts of oil and gas are present, continue the following steps.

Steps 7–11 (Revised). If the cement is to be cured under ambient hydrostatic conditions, pump down a Latching Float Collar Valve Assembly with mud until it latches into place in the notches provided in the Latching Sub located above the drill bit.

Steps 12–13 (Revised). To "cure the cement under ambient hydrostatic conditions", typically execute a two-plug cementing procedure involving a first Bottom Wiper Plug before and a second Top Wiper Plug behind the cement that also minimizes cement contamination comprised of the following individual steps:

A. Introduce the Bottom Wiper Plug into the interior of the drill string assembled in the well and pump down with cement that cleans the mud off the walls and separates the mud and cement.

B. Introduce the Top Wiper Plug into the interior of the drill string assembled into the well and pump down with water thereby forcing the cement through any Float Collar Valve Assembly present and through the watercourses in "a regular bit" or through the mud nozzles of a "jet bit" or through any other mud passages in the drill bit into the annulus between the drill string and the formation.

C. After the Bottom Wiper Plug, and Top Wiper Plug have seated in the Latching Float Collar Valve Assembly, release the pressure on the interior of the drill string that results in the closing of the float collar which in turn prevents cement from backing up in the drill string. The resulting pressure release upon closure of the float collar prevents distortions of the drill string that might prevent a good cement seal as described earlier. Ie, "the cement is cured under ambient hydrostatic conditions".

Repeat Step 14 above.

Therefore, the "New Drilling Process" has only 7 distinct steps instead of the 14 steps in the "Typical Drilling Process". The "New Drilling Process" consequently has fewer steps, is easier to implement, and will be less expensive.

The preferred embodiment of the invention disclosed in FIG. 1 requires a Latching Subassembly and a Latching Float Collar Valve Assembly. An advantage of this approach is that the Float 32 of the Latching Float Collar Valve Assembly and the Float Seating Surface 34 in FIG. 1 are installed at the end of the drilling process and are not subject to any wear by mud passing down during normal drilling operations.

Another preferred embodiment of the invention provides a float and float collar valve assembly permanently installed within the Latching Subassembly at the beginning of the drilling operations. However, such a preferred embodiment has the disadvantage that drilling mud passing by the float and the float collar valve assembly during normal drilling operations could subject the mutually sealing surfaces to potential wear. Nevertheless, a float collar valve assembly can be permanently installed above the drill bit before the drill bit enters the well.

Figure 2:
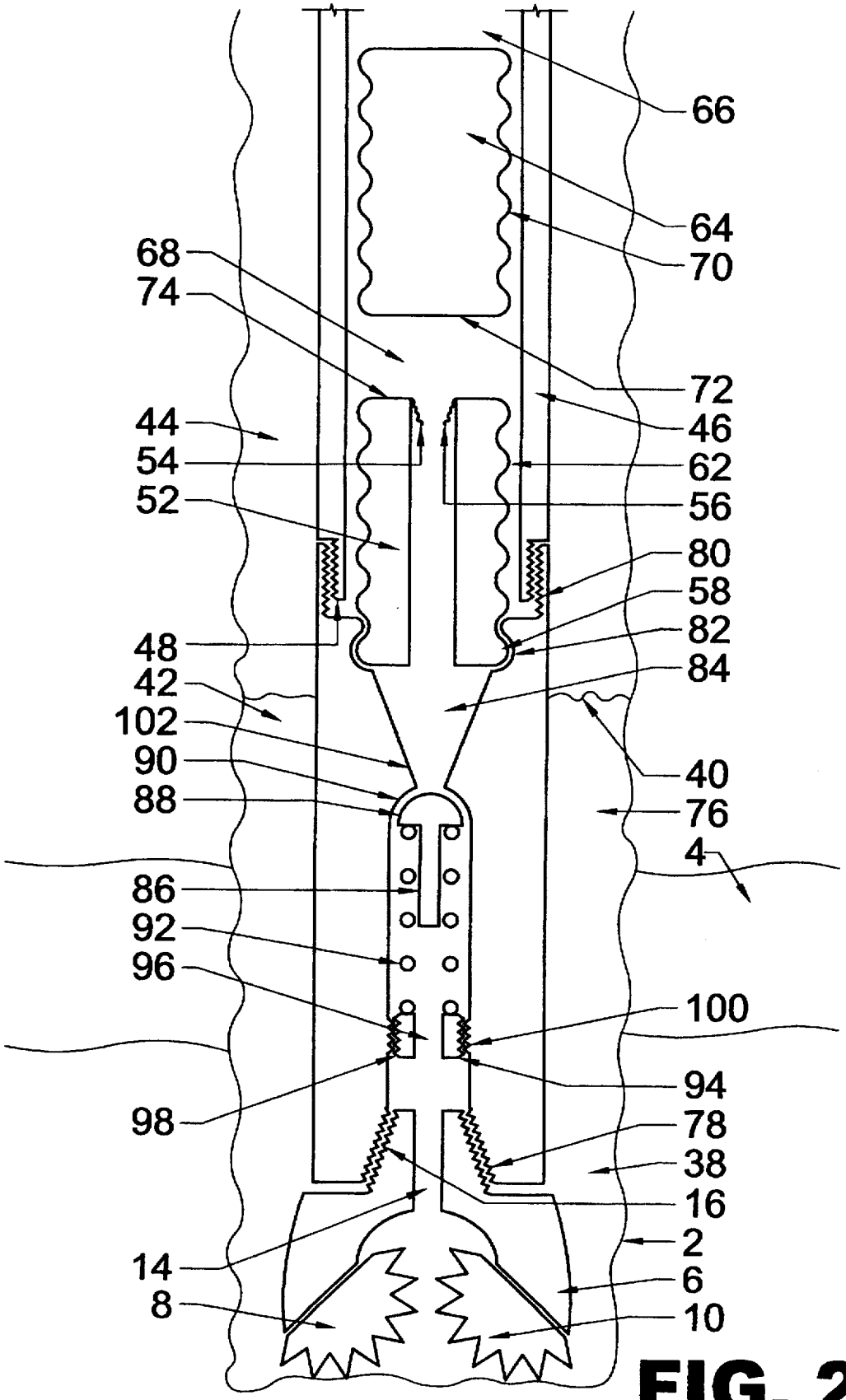
FIG. 2 shows a section view of a rotary drill string having a rotary drill bit in the process of being cemented into place during one drilling pass into formation by using a Permanently Installed Float Collar Valve Assembly that is permanently installed above the rotary drill bit that is a preferred embodiment of the invention.

FIG. 2 shows another preferred embodiment of the invention that has such a float collar valve assembly permanently installed above the drill bit before the drill bit enters the well. FIG. 2 shows many elements common to FIG. 1. The Permanently Installed Float Collar Valve Assembly 76, hereinafter abbreviated as the "PIFCVA", is installed into the drill string on the surface of the earth before the drill bit enters the well. On the surface, the threads 16 on the rotary drill bit 6 are screwed into the lower female threads 78 of the PIFCVA. The bottom male threads of the drill pipe 48 are screwed into the upper female threads 80 of the PIFCVA. The PIFCVA Latching Sub Recession 82 is similar in nature and function to element 60 in FIG. 1. The fluids flowing thorough the standard water passage 14 of the drill bit flow through PIFCVA Guide Channel 84. The PIFCVA Float 86 has a Hardened Hemispherical Surface 88 that seats against the hardened PIFCVA Float Seating Surface 90 under the force PIFCVA Spring 92. Surfaces 88 and 90 may be fabricated from very hard materials such as tungsten carbide. Alternatively, any hardening process in the metallurgical arts may be used to harden the surfaces of standard steel parts to make suitable hardened surfaces 88 and 90. The lower surfaces of the PIFCVA Spring 92 seat against the upper portion of the PIFCVA Threaded Spacer 94 that has PIFCVA Threaded Spacer Passage 96. The PIFCVA Threaded Spacer 94 has exterior threads that thread into internal threads 100 of the PIFCVA (that is assembled into place within the PIFCVA prior to attachment of the drill bit to the PIFCVA). Surface 102 facing the lower portion of the PIFCVA Guide Channel 84 may also be made from hardened materials, or otherwise surface hardened, so as to prevent wear from the mud flowing through this portion of the channel during drilling.

Once the PIFCVA is installed into the drill string, then the drill bit is lowered into the well and drilling commenced. Mud pressure from the surface opens PIFCVA Float 86. The steps for using the preferred embodiment in FIG. 2 are slightly different than using that shown in FIG. 1. Basically, the "Steps 7–11 (Revised)" of the "New Drilling Process" are eliminated because it is not necessary to pump down any type of Latching Float Collar Valve Assembly of the type described in FIG. 1. In "Steps 3–5 (Revised)" of the "New Drilling Process", it is evident that the PIFCVA is installed into the drill string instead of the Latching Subassembly appropriate for FIG. 1. In Steps 12–13 (Revised) of the "New Drilling Process", it is also evident that the Lower Lobe of the Bottom Wiper Plug 58 latches into place into the PIFCVA Latching Sub Recession 82.

The PIFCVA installed into the drill string is another example of a one-way cement valve means installed near the drill bit to be used during one-pass drilling of the well. Here, the term "near" shall mean within 500 feet of the drill bit. Consequently, FIG. 2 describes a rotary drilling apparatus to drill a borehole into the earth comprising a drill string attached to a rotary drill bit and one-way cement valve means installed near the drill bit to cement the drill string and rotary drill bit into the earth to make a steel cased well. Here, the method of drilling the borehole is implemented with a rotary drill bit having mud passages to pass mud into the borehole from within a steel drill string that includes at least one step that passes cement through such mud passages to cement the drill string into place to make a steel cased well.

The drill bits described in FIG. 1 and FIG. 2 are milled steel toothed roller cone bits. However, any rotary bit can be used with the invention. A tungsten carbide insert roller cone bit can be used. Any type of diamond bit or drag bit can be used. The invention may be used with any drill bit described in Ref. 3 above that possesses mud passages, waterpassages, or passages for gas. Any type of rotary drill bit can be used possessing such passageways. Similarly, any type of bit whatsoever that utilizes any fluid or gas that passes through passageways in the bit can be used whether or not the bit rotates. As another example, a new type of drill bit invented by the inventor of this application can be used that is disclosed in the file-wrapper-continuation application Ser. No. 08/664,791, having filing date of Jun. 17, 1996 entitled "Monolithic Self Sharpening Rotary Drill Bit Having Tungsten Carbide Rods Cast in Steel Alloys" that issued as U.S. Pat. No. 5,615,747. A continuation application of U.S. Pat. No. 5,615,747, having the same title, has been filed that is Ser. No. 08/825,575. As yet another example of "any type of bit whatsoever", FIG. 3 shows the use of the invention using coiled-tubing drilling techniques.

Figure 3:
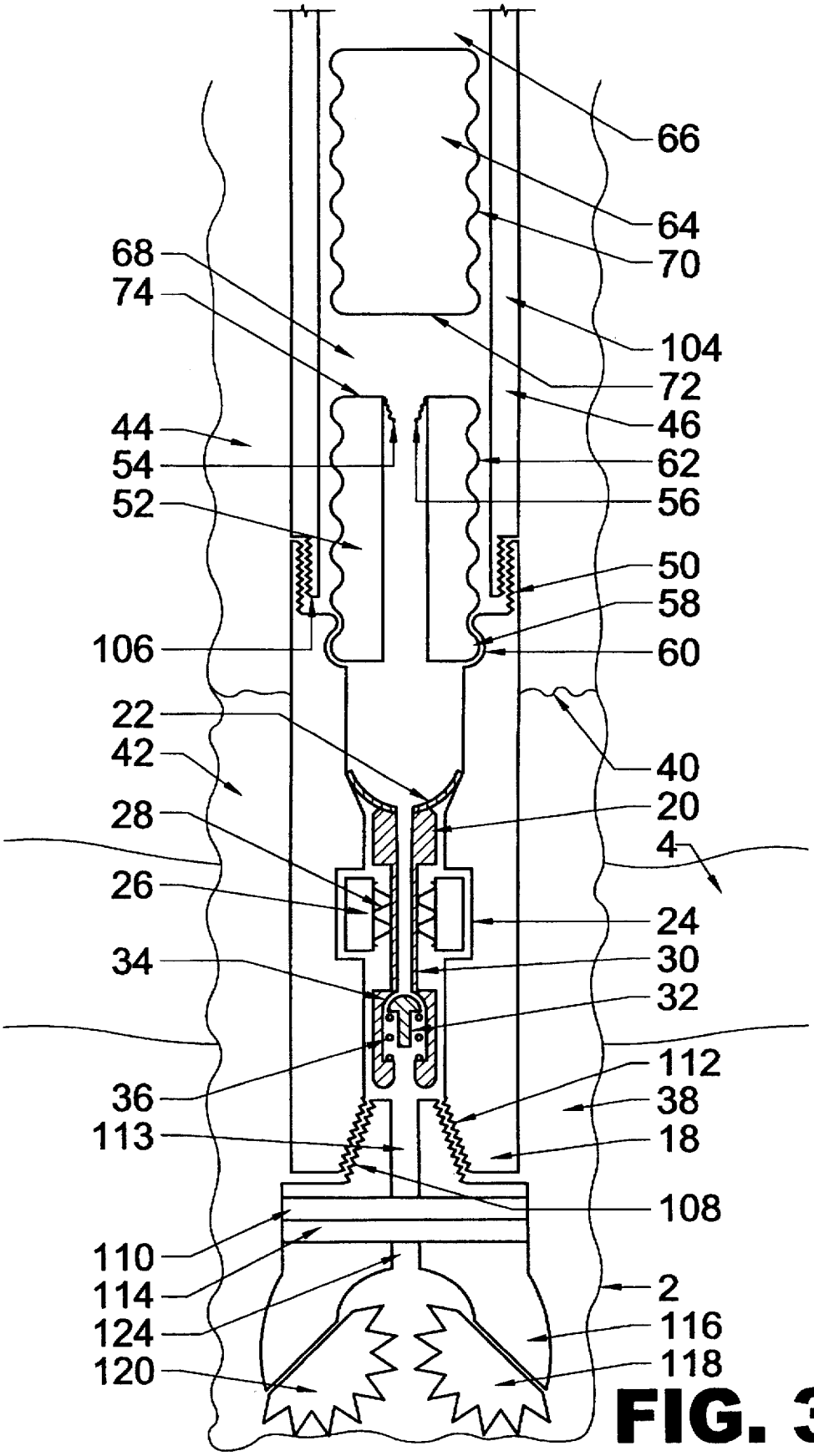
FIG. 3 shows a section view of a tubing conveyed mud motor drilling apparatus in the process of being cemented into place during one drilling pass into formation by using a Latching Float Collar Valve Assembly that has been pumped into place above the rotary drill bit that is a preferred embodiment of the invention.

FIG. 3 shows another preferred embodiment of the invention that is used for certain types of coiled-tubing drilling applications. FIG. 3 shows many elements common to FIG. 1. It is explicitly stated at this point that all the standard coiled-tubing drilling arts now practiced in the industry are incorporated herein by reference. Not shown in FIG. 3 is the coiled tubing drilling rig on the surface of the earth having among other features, the coiled tubing unit, a source of mud, mud pump, etc. In FIG. 3, the well has been drilled. This well can be: (a) a freshly drilled well; or (b) a well that has been sidetracked to a geological formation from within a casing string that is an existing cased well during standard re-entry applications; or (c) or a well that has been sidetracked from within a tubing string that is in turn suspended within a casing sting in an existing well during certain other types of re-entry applications. Therefore, regardless of how drilling is initially conducted, in an open hole, or from within a cased well that may or may not have a tubing string, the apparatus shown in FIG. 3 drills a borehole 2 through the earth including through geological formation 4.

Before drilling commences, the lower end of the coiled tubing 104 is attached to the Latching Subassembly 18 . The bottom male threads of the coiled tubing 106 thread into the female threads of the Latching Subassembly 50.

The top male threads 108 of the Stationary Mud Motor Assembly 110 are screwed into the lower female threads 112 of Latching Subassembly 18. Mud under pressure flowing through channel 113 causes the Rotating Mud Motor Assembly 114 to rotate in the well. The Rotating Mud Motor Assembly 114 causes the Mud Motor Drill Bit Body 116 to rotate. That Mud Motor Drill Bit Body holds in place milled steel roller cones 118, 120, and 122 (not shown for simplicity). A standard water passage 124 is shown through the Mud Motor Drill Bit Body. During drilling operations, as mud is pumped down from the surface, the Rotating Mud Motor Assembly 114 rotates causing the drilling action in the well. It should be noted that any fluid pumped from the surface under sufficient pressure that passes through channel 113 goes through the mud motor turbine (not shown) that causes the rotation of the Mud Motor Drill Bit Body and then flows through standard water passage 124 and finally into the well.

The steps for using the preferred embodiment in FIG. 3 are slightly different than using that shown in FIG. 1. In drilling an open hole, "Steps 3–5 (Revised)" of the "New Drilling Process" must be revised here to site attachment of the Latching Subassembly to one end of the coiled tubing and to site that standard coiled tubing drilling methods are employed. The coiled tubing can be on the coiled tubing unit at the surface for this step or the tubing can be installed into a wellhead on the surface for this step. In "Step 6 (Revised)" of the "New Drilling Process", measurements are to be performed from within the coiled tubing when it is disposed in the well. In "Steps 12–13 (Revised)" of the "New Drilling Process", the Bottom Wiper Plug and the Top Wiper Plug are introduced into the upper end of the coiled tubing at the surface. The coiled tubing can be on the coiled tubing unit at the surface for these steps or the tubing can be installed into a wellhead on the surface for these steps. In sidetracking from within an existing casing, in addition to the above steps, it is also necessary to lower the coiled tubing drilling apparatus into the cased well and drill through the casing into the adjacent geological formation at some predetermined depth. In sidetracking from within an existing tubing string suspended within an existing casing string, it is also necessary to lower the coiled tubing drilling apparatus into the tubing string and then drill through the tubing string and then drill through the casing into the adjacent geological formation at some predetermined depth.

Therefore, FIG. 3 shows a tubing conveyed mud motor drill bit apparatus, to drill a borehole into the earth comprising tubing attached to a mud motor driven rotary drill bit and one-way cement valve means installed above the drill bit to cement the drill string and rotary drill bit into the earth to make a tubing encased well. The tubing conveyed mud motor drill bit apparatus is also called a tubing conveyed mud motor drilling apparatus, that is also called a tubing conveyed mud motor driven rotary drill bit apparatus. Put another way, FIG. 3 shows a section view of a coiled tubing conveyed mud motor driven rotary drill bit apparatus in the process of being cemented into place during one drilling pass into formation by using a Latching Float Collar Valve Assembly that has been pumped into place above the rotary drill bit. Methods of operating the tubing conveyed mud motor drilling apparatus in FIG. 3 include a method of drilling a borehole with a coiled tubing conveyed mud motor driven rotary drill bit having mud passages to pass mud into the borehole from within the tubing that includes at least one step that passes cement through said mud passages to cement the tubing into place to make a tubing encased well.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. A method of drilling a borehole with a rotary drill bit having mud passages for passing mud into the borehole from within a steel drill string that includes at least one step of passing cement through said mud passages for the purpose of cementing the drill string into place to make a steel cased well.

2. A rotary drilling apparatus to drill a borehole into the earth comprising a drill string attached to a rotary drill bit and one-way cement valve means installed above the drill bit to cement the drill string and rotary drill bit into the earth to make a steel cased well.

3. A method of drilling a borehole with a coiled tubing conveyed mud motor driven rotary drill bit having mud passages for passing mud into the borehole from within the tubing that includes at least one step of passing cement through said mud passages for the purpose of cementing the tubing into place to make a tubing encased well.

4. A tubing conveyed mud motor drilling apparatus to drill a borehole into the earth comprising tubing attached to a mud motor driven rotary drill bit and one-way cement valve means installed above the drill bit to cement the drill string and rotary drill bit into the earth to make a tubing encased well.

* * * * *

US005894897C1

(12) EX PARTE REEXAMINATION CERTIFICATE (8906th)

United States Patent
Vail, III

(10) Number: US 5,894,897 C1
(45) **Certificate Issued: *Mar. 20, 2012**

(54) METHOD AND APPARATUS FOR CEMENTING DRILL STRINGS IN PLACE FOR ONE PASS DRILLING AND COMPLETION OF OIL AND GAS WELLS

(75) Inventor: William Banning Vail, III, Bothell, WA (US)

(73) Assignee: Weatherford/Lamb, Inc., Houston, TX (US)

Reexamination Request:
No. 90/010,342, Nov. 18, 2008

Reexamination Certificate for:

| | |
|---|---|
| Patent No.: | **5,894,897** |
| Issued: | **Apr. 20, 1999** |
| Appl. No.: | **08/708,396** |
| Filed: | **Sep. 3, 1996** |

( * ) Notice: This patent is subject to a terminal disclaimer.

Related U.S. Application Data

(63) Continuation-in-part of application No. 08/323,152, filed on Oct. 14, 1994, now Pat. No. 5,551,521.

(51) Int. Cl.
*E21B 7/20* (2006.01)
*E21B 27/00* (2006.01)

(52) U.S. Cl. ..... 175/318; 166/285

(58) Field of Classification Search ..... 166/285; 175/318
See application file for complete search history.

(56) References Cited

To view the complete listing of prior art documents cited during the proceeding for Reexamination Control Number 90/010,342, please refer to the USPTO's public Patent Application Information Retrieval (PAIR) system under the Display References tab.

*Primary Examiner*—Jimmy G Foster

(57) ABSTRACT

The steel drill string attached to a drilling bit during typical rotary drilling operations used to drill oil and gas wells is used for a second purpose as the casing that is cemented in place during typical oil and gas well completions. Methods of operation are described that provide for the efficient installation a cemented steel cased well wherein the drill string and the drill bit are cemented into place during one single drilling pass down into the earth. The normal mud passages or watercourses present in the rotary drill bit are used for the second independent purpose of passing cement into the annulus between the casing and the well while cementing the drill string into place during one single pass into the earth. A one-way cement valve is installed near the drill bit of the drill string that allows the cement to set up efficiently under ambient hydrostatic conditions while the drill string and drill bit are cemented into place during one single drilling pass into the earth. That one-way cement valve can be pumped down from the surface or can be permanently installed above the rotary drill bit. Procedures are described to drill a borehole with a tubing conveyed mud motor drilling apparatus that is cemented in place to make a tubing encased well.

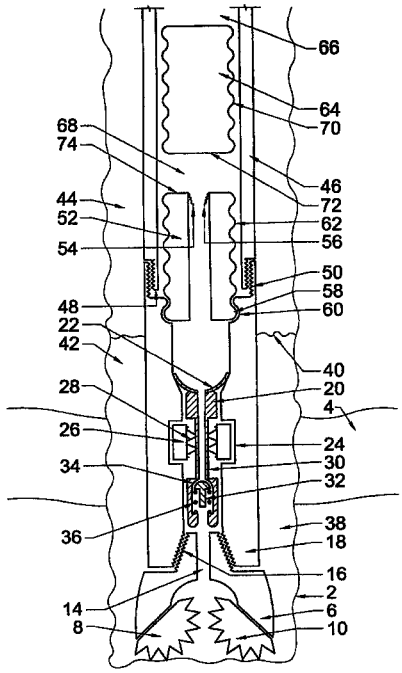

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

Claim 2 is determined to be patentable as amended.

New claims 5 and 6 are added and determined to be patentable.

Claims 3 and 4 were not reexamined.

2. A rotary drilling apparatus to drill a borehole into the earth comprising a drill string attached to a rotary drill bit, *the drill string including an interior passageway defined by a wall, with an annular recess formed in the wall of the passageway,* and one-way cement valve means, *comprising a latch for engagement with the annular recess,* installed above the drill bit *after a casing portion is in the wellbore,* to cement the drill string and rotary drill bit into the earth to make a steel cased well.

*5. The rotary drilling apparatus of claim 2, and further comprising first and second wiper plugs separate from the one-way valve adapted to be lowered through the interior passageway of the casing portion after the one-way valve is installed, with a charge of cement therebetween.*

*6. A method of drilling a borehole with a rotary drill bit having mud passages for passing mud into the borehole from within an interior passageway of a steel drill string and a one-way cement valve installed in the interior passageway above the drill bit, the method comprising the step of installing the one-way valve in the interior passageway after the steel drill string is located within the borehole, and after the one-way valve is installed, lowering first and second wiper plugs separate from the one-way valve through the interior passageway, with a charge of cement therebetween, and performing at least one step of passing cement through said one-way valve and said mud passages for the purpose of cementing the drill string into place to make a steel cased well.*

* * * * *